US010488039B2

(12) United States Patent
Shmelev et al.

(10) Patent No.: US 10,488,039 B2
(45) Date of Patent: Nov. 26, 2019

(54) METHOD FOR SURFACE STABILIZED COMBUSTION (SSC) OF GASEOUS FUEL/OXIDANT MIXTURES AND A BURNER DESIGN THEREOF

(71) Applicants: Vladimir Shmelev, Moscow (RU); Nikolay Vasilik, Moscow (RU); Mark Khinkis, Morton Grove, IL (US); Aleksandr Kozlov, Buffalo Grove, IL (US); David Cygan, Villa Park, IL (US); David Kalensky, Chicago, IL (US); Brian Sutherland, Chicago, IL (US)

(72) Inventors: Vladimir Shmelev, Moscow (RU); Nikolay Vasilik, Moscow (RU); Mark Khinkis, Morton Grove, IL (US); Aleksandr Kozlov, Buffalo Grove, IL (US); David Cygan, Villa Park, IL (US); David Kalensky, Chicago, IL (US); Brian Sutherland, Chicago, IL (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 141 days.

(21) Appl. No.: 15/016,469

(22) Filed: Feb. 5, 2016

(65) Prior Publication Data

US 2016/0230986 A1 Aug. 11, 2016

Related U.S. Application Data

(60) Provisional application No. 62/113,868, filed on Feb. 9, 2015.

(51) Int. Cl.
*F23D 14/14* (2006.01)
*F23D 14/08* (2006.01)
(Continued)

(52) U.S. Cl.
CPC ..... *F23D 14/145* (2013.01); *F23D 14/08* (2013.01); *F23D 14/14* (2013.01); *F23D 14/16* (2013.01); *F23D 14/84* (2013.01)

(58) Field of Classification Search
None
See application file for complete search history.

(56) References Cited

U.S. PATENT DOCUMENTS 1,830,826 A * 11/1931 Cox ..... F23D 14/16 264/113
3,170,504 A * 2/1965 Lanning ..... F23C 99/00 126/92 R
(Continued)

FOREIGN PATENT DOCUMENTS

RU 2012 129 061 C1 2/2014

OTHER PUBLICATIONS

"Surface Burning on a Foam Metal Matrix With the Ceramic Coating," Vladimir M. Shmelev, Combustion Sci Technol., 186:943-952, 2014, accepted Jan. 30, 2014.*
(Continued)

*Primary Examiner* — Avinash A Savani
*Assistant Examiner* — Martha M Becton
(74) *Attorney, Agent, or Firm* — Pauley Erickson & Kottis

(57) ABSTRACT

Methods of burning combustible gas mixtures on a surface of a permeable matrix providing surface stabilized combustion (SSC) with increasing amounts of radiation energy emitted by the surface of the permeable matrix and decreasing concentrations of pollutant components in the combustion products are provided. The gas mixture is fed to a burner that includes a permeable matrix material having a first thermal conductivity. The gas mixture is preheated as it travels through the permeable matrix material. The gas
(Continued)

Comparison between the coated and uncoated matrix surface (left) and the structure of the ceramic film (right)

mixture is then combusted at or near exit pores and channels formed at a combustion surface of the permeable matrix material, the combustion surface at least in part coated with a coating material having a thermal conductivity less than the permeable matrix material thermal conductivity and a high optical transmittance in the infrared spectrum.

15 Claims, 5 Drawing Sheets

(51) Int. Cl.
*F23D 14/84* (2006.01)
*F23D 14/16* (2006.01)

(56) References Cited

U.S. PATENT DOCUMENTS 3,188,366 A * 6/1965 Flynn ..... F23D 14/16 156/308.4
3,199,573 A * 8/1965 Fiynn ..... F23D 14/16 239/145
3,216,478 A * 11/1965 Saunders ..... F23D 14/18 239/145
3,251,396 A * 5/1966 Nitsche ..... F23C 99/00 431/328
3,726,633 A * 4/1973 Vasilakis ..... F23D 14/14 431/329
3,738,793 A * 6/1973 Reid ..... F23D 14/16 431/328
3,751,213 A * 8/1973 Sowards ..... F23C 99/00 431/328
3,912,443 A * 10/1975 Ravault ..... B32B 18/00 431/328
4,377,618 A * 3/1983 Ikeda ..... C23D 5/00 264/125
4,597,734 A 7/1986 McCausland et al.
4,599,066 A 7/1986 Granberg
4,643,667 A * 2/1987 Fleming ..... F23D 14/16 431/328
4,746,287 A * 5/1988 Lannutti ..... B28B 19/0038 264/256
4,878,837 A * 11/1989 Otto ..... C04B 38/067 126/91 A
4,883,423 A * 11/1989 Holowczenko ..... C04B 30/02 264/45.3
4,886,972 A * 12/1989 Nakai ..... C09K 9/00 250/493.1
4,889,481 A * 12/1989 Morris ..... B32B 18/00 126/92 AC
4,977,111 A * 12/1990 Tong ..... C04B 28/06 431/328
5,147,201 A * 9/1992 Xiong ..... F23C 99/006 126/92 AC
5,165,887 A * 11/1992 Ahmady ..... F23D 14/16 126/92 AC
5,218,952 A * 6/1993 Neufeldt ..... E01C 23/14 126/92 AC
5,249,953 A * 10/1993 Roth ..... F23D 14/16 126/92 AC
5,326,257 A * 7/1994 Taylor ..... F23D 14/14 431/329
5,356,487 A * 10/1994 Goldstein ..... F23N 1/022 122/235.11
5,380,192 A * 1/1995 Hamos ..... F23D 14/02 431/328
5,444,261 A * 8/1995 Kim ..... G06F 1/1601 250/493.1
5,476,375 A * 12/1995 Khinkis ..... F23C 6/045 122/18.4
5,500,054 A * 3/1996 Goldstein ..... H02S 10/30 136/246
5,711,661 A * 1/1998 Kushch ..... F23D 14/12 431/326
5,749,721 A * 5/1998 Klinge ..... F23D 14/16 431/328
5,762,885 A * 6/1998 Debbage ..... B01D 53/8696 422/171
5,782,629 A * 7/1998 Lannutti ..... F23D 14/16 431/326
5,993,192 A * 11/1999 Schmidt ..... F23D 14/18 431/12
6,159,001 A * 12/2000 Kushch ..... F23D 14/12 122/4 D
6,354,831 B1 * 3/2002 Wilk, Jr. ..... F23D 14/16 126/512
6,575,736 B1 * 6/2003 Aust ..... F23D 14/14 431/328
2015/0253005 A1 * 9/2015 Sutherland ..... F23D 14/16 431/328
2016/0003471 A1 * 1/2016 Karkow ..... F23C 5/06 431/2
2016/0024962 A1 * 1/2016 Luthra ..... C04B 41/455 428/312.6
2016/0153288 A1 * 6/2016 Luthra ..... F01D 5/284 428/215
2016/0160664 A1 * 6/2016 Luthra ..... C04B 41/89 428/332

OTHER PUBLICATIONS

V.M. Shmelev, "Combustion of Natural Gas at the Surface of a High-Porosity Metal Matrix," 2010 Russian Journal of Physical Chemistry B, 2010, vol. 4, No. 4, pp. 593-601 (Year: 2010).*
Susie Wood, Andrew T. Harris, "Porous Burners for Lean-Burn Applications," 2008 Progress in Energy and Combustion Science 34 667-684 (Year: 2008).*
Russian Journal of Physical Chemistry B, 2010, vol. 4, No. 4, pp. 593-601 @Pleiades Publishing, Ltd. 2010 Original: Shmelev, V.M., "Combustion of Natural Gas at the Surface of a high-Porosity Metal Matrix," Chemical Physics, 2010, vol. 29, No. 7, pp. 27-36.
Kirdyashkin, A.I. et al., "Energy and spectral characteristics of the radiation in the process of filtration combustion of natural gas," SCF, 2010, vol. 46, No. 5, pp. 37-41 (English Abstract).
Vasiliki, N.Y., et al., "Formation of the ceramic coating of the multi-detonation unit," Combustion and Explosion, Torus Press, 2014, pp. 241-244 (English Abstract).
Shmelev, V.M., "Surface Burning on a Foam Metal Matrix with the Ceramic Coating," Combus. Sci. Technol., 2014, 186, pp. 943-952.

* cited by examiner

Comparison between the coated and uncoated matrix surface (left) and the structure of the ceramic film (right)

The matrix surface temperature (1, 2) and its reverse side temperature (3, 4) from the power density for uncoated surface (2, 4) and coated surface (1, 3) at differenct power density (W) with excess air factor $\alpha = 1.1$. Points with a cross are from the ceramic coating matrix; points with the vertical line are from the initial uncoated matrix.

Flue gas CO and NOx corrected concentrations at different firing rate (α=1.1).

Flue gas CO and NOx corrected concentrations at different excess air ratio (W=33w/cm2).

METHOD FOR SURFACE STABILIZED COMBUSTION (SSC) OF GASEOUS FUEL/OXIDANT MIXTURES AND A BURNER DESIGN THEREOF

CROSS REFERENCE TO RELATED APPLICATION

This application claims the benefit of U.S. Provisional Patent Application, Ser. No. 62/113,868, filed on 9 Feb. 2015. The co-pending Provisional Patent Application is hereby incorporated by reference herein in its entirety and is made a part hereof, including but not limited to those portions which specifically appear hereinafter.

FIELD OF INVENTION

The invention is generally relates to pre-mix combustion technology. The invention can be used in and for the development of ecologically clean compact cost-effective heat generators and infrared radiators such as for use in numerous various applications in the residential, commercial, and industrial areas.

BACKGROUND

Surface Stabilized Combustion (SSC) of gaseous fuel/oxidant mixtures on a permeable matrix can reduce emissions of flue gas pollutants (e.g., NOx, CO, UHC), increase radiation density, and increase thermal efficiency all of which factors are important to the design of advanced compact cost-effective radiation heating combustion devices. Through the effective utilization of SSC, radiation heat flux from the matrix surface can be increased up to 80% of the heat flux providing from 20 to 40% of the total energy released from combustion by infrared radiation. Such radiation enhancement is primarily due to surface combustion on the matrix. Based on intensive heat exchange between the combustion products and the matrix, the matrix surface is heated to high temperatures. The peak flame temperature and resulting combustion products temperature in the combustion zone is in turn reduced which reduces the combustion products NOx concentration.

The distance between the combustion zone and the matrix surface is dependent on the thermal conductivity of the gas mixture exit layer of the matrix. With the gas mixture exit layer exhibiting a relatively high thermal conductivity, the flame is located at some distance from the matrix surface. In such case, most of the energy released by combustion is carried by the combustion products. A small part of the energy released by combustion is transferred to the permeable matrix. A portion of the heat transferred to the matrix is radiated to the load and a portion is transferred back to the gas mixture and stabilizes the surface combustion.

One existing method and apparatus for the SSC of fuel/oxidant gas mixtures involves SSC on a permeable matrix consisting of particles of a heat-resistant metal alloy containing iron, chromium and aluminum. Refractory alloys containing aluminum are on the surface of the matrix. When heated in the presence of oxygen, a dense aluminum oxide film 1 micron in thickness is developed which prevents further oxidation of the surface and protects the surface from corrosion. However, such a thin film of aluminum oxide significantly affects only the chemical oxidation processes of the surface and has no significant effect on the heat exchange between the combustion products and the surface of the burner.

A device is known for the implementation of gas surface combustion on the outside surface of a sleeve of woven ceramic fibers. The sleeve is worn on a perforated metal carrier, through which the fuel/oxidant gas mixture is fed to the fabric sleeve. A disadvantage of this device is that the heating of the gas mixture while the gas mixture passes through the perforated metal carrier is insufficient to ignite (and maintain) combustion of the gas mixture. The sleeve of woven ceramic fibers substantially prevents heat transfer between the combustion products and the surface of the perforated metal carrier. Thus, an auxiliary triggering device is used to initiate (and maintain) combustion of the gas mixture over the outer surface of the woven ceramic fiber sleeve.

Another existing device burns gas on the surface of a thick layer of ceramic fibers and polymers deposited on the surface of a corrosion resistant mesh screen. The thickness of the layer of ceramic fibers and the polymers is selected to prevent corrosion heating of the mesh screen. The thickness of the layer of ceramic fibers and polymers is from 6.35 mm to 12.7 mm. A disadvantage of this device is the fact that during operation the gas mixture is preheated and burnt within the thick layer surface of ceramic fibers and polymers are burnt out and degrade.

SUMMARY OF THE INVENTION

One aspect of present invention involves the ability to redistribute the flows of heat released by burning of the gas mixtures, thereby increasing the temperature of the emitting surface of the matrix and thus increase the portion of the heat that is carried away from the permeable matrix in the form of radiation.

The subject method and apparatus, in accordance with selected embodiments, involves or includes starting the gas combustion process through pre-heating of the gas mixture as it moves through the permeable matrix. The proposed process may further include the utilization of a bulk permeable matrix formed from metal having high thermal conductivity which allows preheating the gas mixture to a temperature close to the temperature of ignition. The surface of the matrix and the surface of the pores and channels near the gas mixture exit of the matrix are preferably coated by or with a layer of material having a thermal conductivity several times reduced as compared to the thermal conductivity of the matrix material.

In accordance with one aspect of the invention, to optimize the SSC process, it is desirable to maintain a high rate of heat exchange between the pore and channel surfaces within the body of the matrix and the gas mixture as optimization of preheating of the mixture can desirably avoid flame extinction. In the combustion zone, the flow of heat from the combustion products to the surface is preferably maintained at a level to avoid the flame extinction providing steady state SSC. To optimize the combustion process and achieve enhanced SSC, the permeable matrix is preferably a combined matrix comprising a material with a high thermal conductivity (e.g., metal) coated with a material with a low thermal conductivity (e.g., ceramics).

Experiments have shown that with the flame immersed in the pores and channels of the ceramic coated side of the permeable matrix, both the heat flux from the combustion products to the coated side of the matrix and the surface temperature of the coated side of the matrix increase. Increasing the temperature of the matrix according to the Stefan-Boltzmann law leads to an increase in the energy flux emitted by the matrix surface. The possibility of stable operation of the burner in such conditions is determined by the thermal characteristics of the matrix material of the burner. The technology provides the formation of a ceramic coating such as of aluminum oxide on the surface of a matrix such as of highly permeable volumetric porous metal foam. In accordance with an aspect of the invention, one of the features of the subject method of forming coatings is the ability to apply dense ceramic coatings to a surface with high adhesion and at high speeds with minimal impact to the surface, thus allowing the coating to be applied to brittle surfaces. At the same time, the technology allows a high-speed application of ceramic powder particles to form a ceramic coating having a higher ductility as compared to those provided or resulting from other methods of application. The plasticity of such a resulting ceramic coating allows it to operate in a stable manner in or under conditions of high temperature gradients. The optical transparency of the ceramic coating (e.g., alumina or zirconia) provides that at a coating thickness of 50 to 200 microns heat can effectively be dissipated by radiation from the combustion zone, dipping below the surface of the matrix. This is very important, since the emissivity of the metallic matrix is several times higher than that of the ceramic coating (e.g., alumina or zirconia), providing significantly higher radiation flux.

The invention, in accordance with specific particular embodiments, comprises or involves significant features not previously known. For example, particular embodiments of the invention may desirably employ or involve the application and/or use of a thick coating: having a low coefficient of thermal conductivity and transparent in the infrared wavelength range, and having high ductility at the working surface of the burner and on the surface of the pores or channels of the matrix near the outlet of the gas mixture. These features combine to increase the temperature and the flux of radiant energy from the metallic matrix and to increase the strength and the service life of the burner, increase burner efficiency and reduce pollutant emissions.

DETAILED DESCRIPTION

Figures 1A, 1B:
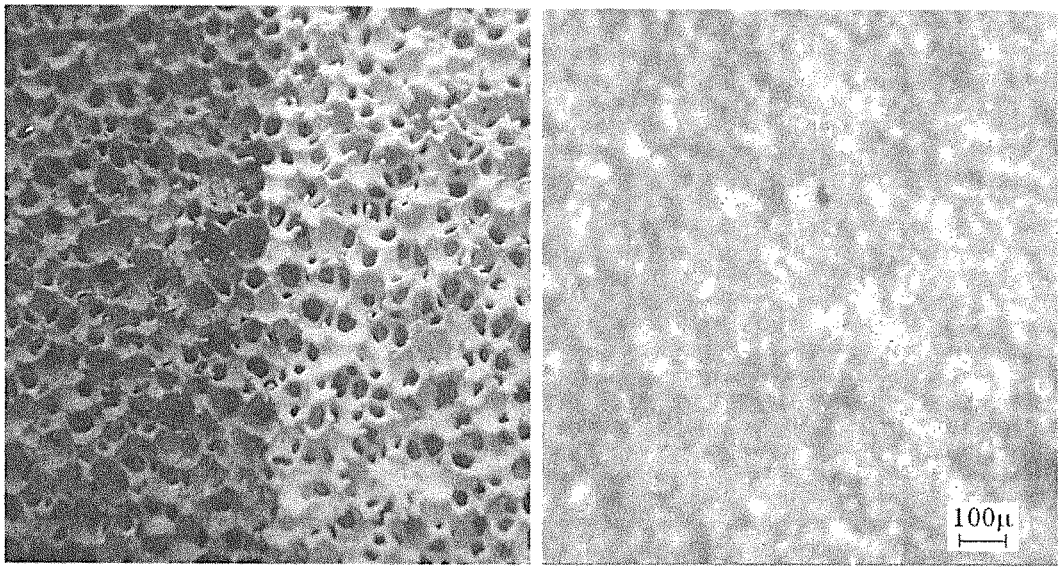
FIG. 1A is a comparative image between a coated and an uncoated matrix surface.
FIG. 1B is an image showing the structure of a ceramic film.

In accordance with one embodiment, there is provided a method of burning combustible gas mixtures on the surface of the permeable matrix with increasing amounts of radiation energy emitted by or from the heated surface of the matrix and decreasing the emission concentration of undesirable species, such as pollutants, such as nitrogen oxide, in the combustion products. Preheat of the fuel/oxidant gas mixture is preferably carried out as the gas mixture moves through the pores and channels of the permeable matrix. Combustion of the gas mixture near the surface of the permeable matrix by the method is preferably provided by introducing between the combustion products and the surface of the matrix, matrix pores and channels surfaces near the combustion products exit a material with a thermal conductivity significantly lower than that of the matrix base material, and by transfer of the combustion zone to the surface of the pores and channels of the permeable matrix at the gas mixture exit. Heat exchange between the combustion products and the matrix base material is preferably carried out through a large contact area of the flame and the walls of the pores and channels. Experiments have shown that moving the region of the combustion zone to under the surface of the permeable matrix increases the surface temperature and reduces the temperature of combustion, as well as reduces the concentration of nitrogen oxides and carbon monoxide in the combustion products. Increasing the temperature of the burner according to the Stefan-Boltzmann law leads to an increase in the radiation energy flux emitted by the matrix surface; decreasing the temperature of the combustion products and leading to a decrease of the energy carried away by the combustion products.

The energy released during the combustion of the gas mixture is preferably distributed so that the amount of radiation energy emitted by the burner increases, and the amount of energy carried away by the combustion products is reduced. Heat dissipation by radiation from the surface of the matrix base material coated with the layer is carried out through the material (ceramic) matrix on the surface that is transparent to IR radiation. Effective heat radiation is achieved with a coating material having a high transparency in the infrared spectrum. In experiments, coating materials of alumina and zirconia were successfully utilized at or with coating thicknesses of 50 to 200 microns. Moving the combustion zone to below or under the surface of the matrix reduces the flame temperature which in accordance with the laws of chemical kinetics results in a decrease in the concentration of nitrogen oxides in the combustion products. Further, the concentration of carbon monoxide can desirably be reduced under these conditions, such reduction at least in part attributable to an increase in the residence time within the combustion zone of a high temperature and a more complete oxidation of carbon monoxide.

In accordance with selected preferred embodiments, the thickness of the high thermal conductivity permeable matrix base material is at least 5 millimeters.

In accordance with selected preferred embodiments, the thickness of the high thermal conductivity permeable matrix base material is no more than 30 millimeters.

In accordance with selected preferred embodiments, the thickness of the coating of a low thermal conductivity high optical transmittance material is at least 10 micrometers.

In accordance with selected preferred embodiments, the thickness of the coating of a low thermal conductivity high optical transmittance material is no more than 500 micrometers.

In accordance with selected preferred embodiments, the ratio of the thermal conductivity of the matrix base material to the thermal conductivity of the coating layer material is at least 3.

In accordance with selected preferred embodiments, the ratio of the thermal conductivity of the matrix base material to the thermal conductivity of the coating layer material is no more than 10.

The heat flux density per permeable matrix radiation surface area provided by a burner, in accordance with selected preferred embodiments, is at least 5 w/cm$^2$.

The heat flux density per permeable matrix radiation surface area provided by a burner, in accordance with selected preferred embodiments, is no more than 200 w/cm$^2$.

In accordance with selected preferred embodiments, the permeable matrix material comprises a metal material, a cermet material or a combination thereof.

In accordance with selected preferred embodiments, the permeable matrix material is chromal, kanthal, heat-resistant steel, carbide of a titanium, aluminum, iron, chromium, yttrium or a combination of two or more of such materials.

Those skilled in the art and guided by the teachings herein provided will understand and appreciate that methods of burning combustible gas mixtures on the surface of a permeable matrix providing surface stabilized combustion (SSC) as herein provided desirably produce or result in increasing amounts of radiation energy emitted by the hot surface of the permeable matrix and decreasing concentrations of toxic components in the combustion products.

Method Example

Experiments to test the effectiveness of the invention were carried out on a burner with an array of highly permeable metal foam (PMF) having a thickness of 14 mm, a bulk porosity and surface permeability corresponding to 0.9 to 0.4. The matrix was of a material called Chromal. On the surface of the matrix, a coating of ceramic aluminum oxide with a thickness of 200 microns was applied (see FIG. 1) via the gas dynamic method and using a multichamber detonation unit. The starting material utilized in the coating powder was AMPERIT 740.0 $Al_2O_3$, procured from H. C. Starck GmbH. The coefficient of thermal conductivity of the coating material is less than six times the coefficient of the thermal conductivity of the matrix material. Tests were carried out with mixtures of natural gas and air at a heat-density of 20 W/cm$^2$ to 80 W/cm$^2$, and changes in the excess air ratio ranging from 1.0 to 1.4. Under all the experimental conditions performed with the matrix with a coating of aluminum oxide, a change of the surface combustion mode was observed. On coated matrices, the flame front was submerged beneath the surface of the matrix, the matrix surface temperature increased and the concentration of nitrogen oxides and carbon monoxide in the combustion products decreased.

Figure 2:
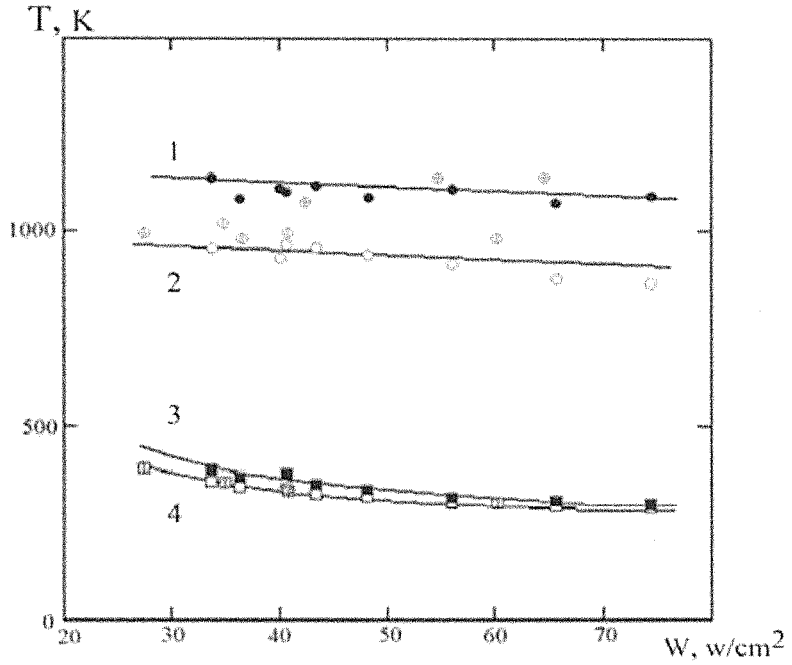
FIG. 2 is a graphical representation of matrix surface temperature and its reverse side temperature for coated and uncoated surfaces at different power densities (W) and with an excess air factor, $\alpha$=1.1.
Figure 3:
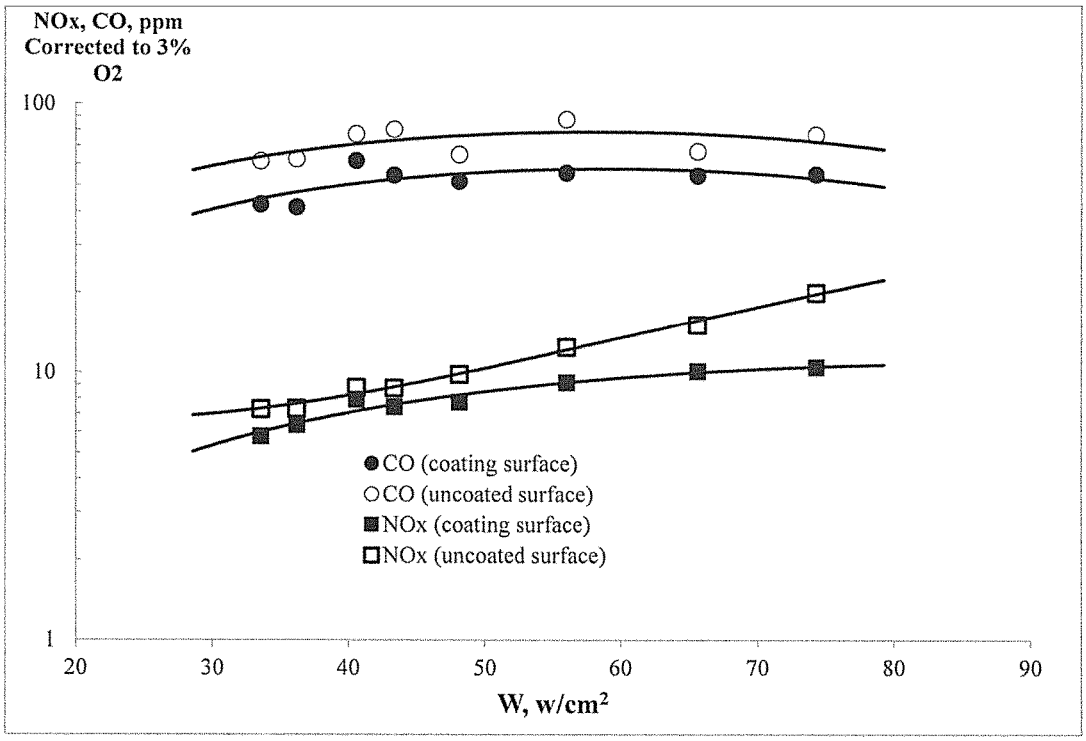
FIG. 3 is a graphical representation of corrected flue gas NOx and CO concentrations versus firing rates and with $\alpha$=1.1.
Figure 4:
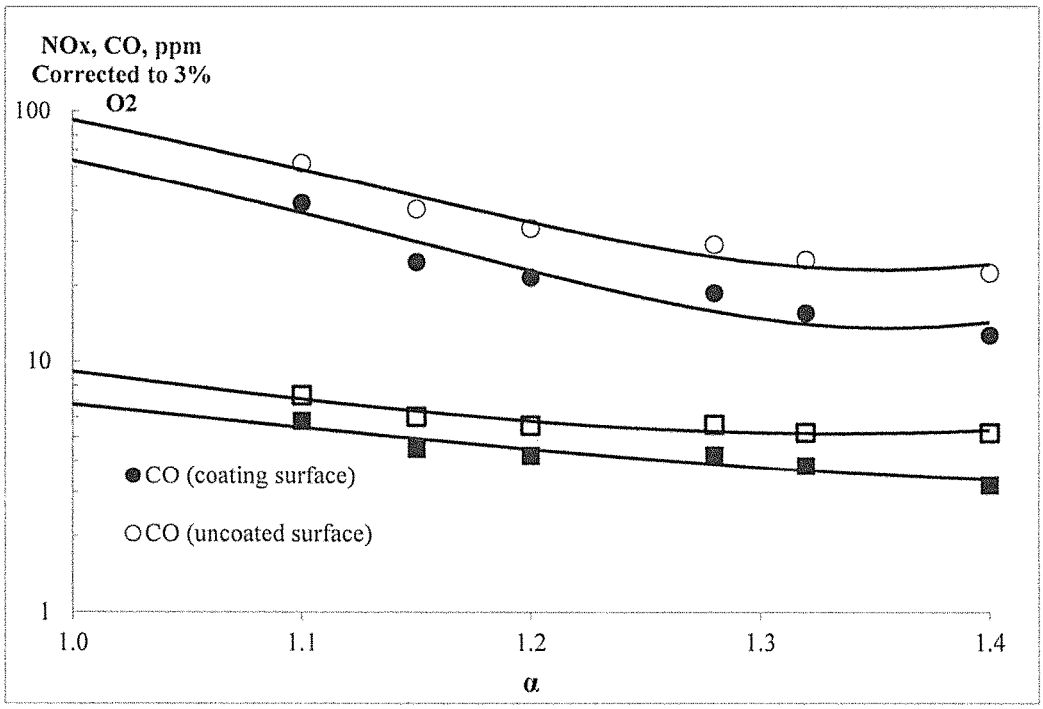
FIG. 4 is a graphical representation of corrected flue gas NOx and CO concentrations versus excess air ratios and with firing rates and with a firing rate (W)=33 w/cm$^2$.

The surface temperatures and concentrations of nitric oxide and carbon monoxide in the combustion products are shown in FIGS. 2, 3 and 4. Experiments have demonstrated the effectiveness of the invention. The temperature of the mold surface with a ceramic coating over the entire range of parameters was about 200 K higher than the temperature of the uncoated matrix. The radiation flux from the coated matrix was two (2) times greater as compared to that of the uncoated matrix. The increase in the radiation flux was accompanied by a decrease in combustion temperature of the combustion products, which reduced the concentration of nitrogen oxides. Under conditions of high heat load (e.g., 80 W/cm$^2$), the concentration of nitrogen oxides in the combustion products for the ceramic-coated matrix was up to two (2) times less than for the uncoated matrix. The concentration of carbon monoxide for matrices with a ceramic coating was approximately one-third (⅓) less than for uncoated matrices.

Figure 5:
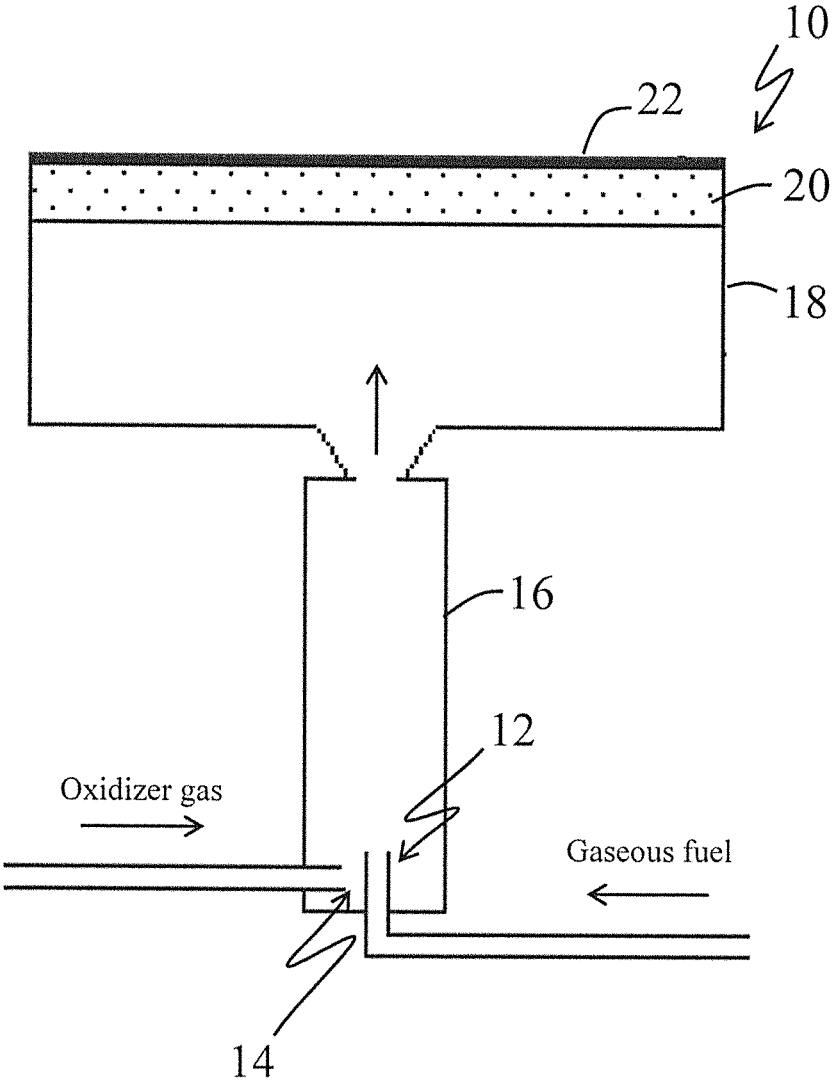
FIG. 5 is a simplified schematic showing a premix burner in accordance with one embodiment of the invention.

Turning to FIG. 5, there is shown a premix burner assembly generally designated by the reference numeral 10, in accordance with one embodiment of the invention. The burner assembly 10 of the invention preferably includes a mixer 16 for mixing gaseous fuel and oxidizer gas with a fuel inlet for receiving a gaseous fuel; and an oxidizer inlet for receiving an oxidizer gas, resulting in production a gas mixture. The burner 10 further includes high thermal conductivity permeable matrix base material 20 to provide surface stabilized combustion at the exit of the mixture by or from the pores and channels. The base material is preferably coated by the layer of the low thermal conductivity material 22 having high optical transmittance in the infrared spectrum. The burner 10 of the subject invention preferably results in embedded combustion located between the high thermal conductivity base material 20 and the low thermal conductivity material 22.

The combustible gas mixture burner assembly 10 is a high-infrared radiation ultra-low pollutants emission premixed gas burner assembly that includes a fuel inlet 12 for receiving a gaseous fuel; an oxidizer inlet 14 for receiving an oxidizer gas; a chamber 16, e.g., a mixer or mixing chamber, to ensure that gaseous fuel and oxidizer are produced into a proper combustible gas mixture; a burner device 18 to which the combustible fuel-oxidizer mixture is introduced and including or having a high thermal conductivity permeable matrix base material 20 providing surface stabilized combustion at the pores and channels of the boundary exit of this mixture to base material coat layered 22 with low thermal conductivity material having high optical transmittance in the infrared spectrum.

As detailed herein, a novel burner design in accordance with at least one embodiment of the invention is based, at least in part, on the ceramic coating of the combustion surface of a metallic permeable matrix. The ceramic coating can desirably function or otherwise serve to achieve or realize one or more of the following: increased energy recuperation or recovery inside the matrix; increased heat transfer to the load; increased thermal efficiency; improved or higher combustion stability; decreased peak flame temperature; and reduced emissions of undesirable species such as NOx, CO, and unburned hydrocarbons (UHC).

In accordance with one embodiment of the invention, a gas burner device or assembly desirably includes a fuel inlet for receiving a gaseous fuel; an oxidizer inlet for receiving an oxidizer gas; a mixer for mixing gaseous fuel and oxidizer gas to produce a combustible gas mixture; a high thermal conductivity permeable matrix base material to provide surface stabilized combustion at the exit of the mixture by or from the pores and channels of the base material which is coated by the layer of the low thermal conductivity material have high optical transmittance in the infrared spectrum.

In accordance with another embodiment of the invention, a gas burner device or assembly desirably includes a fuel inlet for receiving a gaseous fuel; an oxidizer inlet for receiving an oxidizer gas; a chamber to ensure that gaseous fuel and oxidizer are produced into a proper combustible gas mixture; a high thermal conductivity permeable matrix base material providing surface stabilized combustion at pores and/or channels of or at the boundary exit of the mixture to base material coat layered with low thermal conductivity material having high optical transmittance in the infrared spectrum.

Such gas burner devices can be characterized as a high-infrared radiation ultra-low pollutants emission pre-mixed gas burners. Such gas burners can desirably achieve NOx levels below 3vppm, CO levels below 5vppm and UHC levels below 3vppm, at desirably high thermal efficiency, at excess air ratio of below 1.05. Further such burners can desirably achieve stable operation under a wide range of excess oxidant rations (e.g., 0.1 to 4.0, for example). Ultra-low emission high efficiency gas-fired burners are very important in many residential, commercial and industrial applications.

Those skilled in the art and guided by the teachings herein provided will understand and appreciate that the invention, including methods and devices, has broad applicability to various combustible gas mixtures. For example, in particular embodiments the invention can be applied or used in conjunction with combustible gas mixtures formed of various fuel materials, including natural gas, methane, biogas, syngas, turbine exhaust gas and combinations of two or more of such materials, for example, and various oxidant materials, including oxygen, air, oxygen-enriched air and combinations thereof, for example.

The invention, including methods and devices, can be suitably applied to a wide range of residential, commercial and industrial applications including, for example and without unnecessary limitation, water/air heaters/furnaces, gas turbines, syngas generators, dryers, furnaces, boilers and such other applications as may be appreciated by those skilled in the art and guided by the teachings herein provided.

The embodiments of the invention described herein are presently preferred. Various modifications and improvements can be made without departing from the spirit and scope of the invention. The scope of the invention is defined by the appended claims and all changes that fall within the meaning and range of equivalents are intended to be embraced therein.

The invention claimed is:

1. A method of burning a combustible gas mixture on a surface of a permeable matrix base material providing surface stabilized combustion (SSC), the method comprising:

feeding the gas mixture to a burner comprising a permeable matrix base material having a first thermal conductivity;

preheating the gas mixture as it travels through the permeable matrix base material; and combusting the gas mixture at or near exit pores and channels formed in a combustion surface of the permeable matrix base material, the combustion surface at least in part coated with a coating material, the coating material having a thermal conductivity less than the permeable matrix base material thermal conductivity and is optically transparent to IR radiation, wherein the surface of the permeable matrix base material at least in part coated with the coating material emits an increased amount of radiation energy and a decreased concentration of pollutant components in the combustion products as compared to the permeable matrix base material without the coating material;

wherein the burner comprises a ratio of thermal conductivity of the permeable matrix base material and to the coating material is from 3 to 10; and wherein the coating material comprises a ceramic and wherein the coating is of a thickness of 10 to 500 microns and the permeable matrix base comprises a metal material.

2. The method of claim 1 wherein the permeable matrix base material is selected from the group consisting of chromal, kanthal, heat-resistant steel, carbide of titanium, aluminum, iron, chromium, yttrium and combinations thereof.

3. The method of claim 1 wherein the ceramic is selected from the group consisting of alumina, zirconia and combinations thereof.

4. The method of claim 1 additionally comprising maintaining heat flow from the combustion products to the combustion surface to avoid flame extinction and to provide steady state SSC.

5. The method of claim 1 wherein a combustion zone of the burner is transferred and stabilized at the combustible gas mixture exit from the permeable matrix base material to the coating material.

6. The method of claim 1 wherein the method additionally comprises removing radiation from the permeable matrix base material through the material coating material.

7. The method of claim 1 wherein the burner comprises the permeable matrix base material in a thickness of from 5 millimeters to 30 millimeters.

8. The method of claim 7 wherein the coating material comprises a ceramic and wherein the coating is of a thickness of 50 to 200 microns.

9. The method of claim 1 wherein the burner provides a heat flux density per permeable matrix base material radiation surface area of from 5 w/cm$^2$ to 200 w/cm$^2$.

10. A high-infrared radiation ultra-low pollutants emission pre-mixed gas burner comprising:

a fuel inlet for receiving a gaseous fuel; an oxidizer inlet for receiving an oxidizer gas;

a mixer for mixing gaseous fuel and oxidizer gas producing a combustible gas mixture;

a permeable matrix base material providing surface stabilized combustion at the exit of this mixture by the pores and channels of the base material which is coated by a material optically transparent to IR radiation;

wherein the coating material comprises a ceramic and wherein the coating is of a thickness of 10 to 500 microns and the permeable matrix base comprises a metal material and wherein the burner comprises a ratio of thermal conductivity of the permeable matrix base material and to the coating material is from 3 to 10.

11. A high-infrared radiation ultra-low pollutants emission pre-mixed gas burner as recited in claim 10 wherein the thickness of the permeable matrix base material is from 5 millimeters to 30 millimeters.

12. A high-infrared radiation ultra-low pollutants emission pre-mixed gas burner as recited in claim 10 wherein the heat flux density per permeable matrix base material radiation surface area provided by the burner is from 5 w/cm$^2$ to 200 w/cm$^2$.

13. A high-infrared radiation ultra-low pollutants emission pre-mixed gas burner assembly comprising:

a fuel inlet for receiving a gaseous fuel;

an oxidizer inlet for receiving an oxidizer gas;

a chamber to ensure that gaseous fuel and oxidizer are produced into a proper combustible gas mixture;

a burner device to which the combustible gas mixture is introduced, the burner device having a permeable matrix base material providing surface stabilized combustion at the pores and channels of the boundary exit of this mixture to a base material coat layered with a material optically transparent to IR radiation and wherein the base material has a thermal conductivity of 3 to 10 times as great as the coating layer material thermal conductivity and wherein the coating material comprises a ceramic and wherein the coating is of a thickness of 10 to 500 microns and the permeable matrix base comprises a metal material.

14. A high-infrared radiation ultra-low pollutants emission pre-mixed gas burner as recited in claim 13 wherein the thickness of the permeable matrix base material is from 5 millimeters to 30 millimeters.

15. A high-infrared radiation ultra-low pollutants emission pre-mixed gas burner as recited in claim 13 wherein the heat flux density per permeable matrix radiation surface area provided by the burner is from 5 $w/cm^2$ to 200 $w/cm^2$.

* * * * *